US012256884B2

(12) United States Patent
Steeman et al.

(10) Patent No.: US 12,256,884 B2
(45) Date of Patent: Mar. 25, 2025

(54) VACUUM CLEANER NOZZLE

(71) Applicant: KONINKLIJKE PHILIPS N.V., Eindhoven (NL)

(72) Inventors: Jonne Steeman, Hemrik (NL); Matthijs Hendrikus Lubbers, Lieveren (NL); Klaas Hilverda, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 17/262,779

(22) PCT Filed: Jul. 29, 2019

(86) PCT No.: PCT/EP2019/070293
§ 371 (c)(1),
(2) Date: Jan. 25, 2021

(87) PCT Pub. No.: WO2020/030452
PCT Pub. Date: Feb. 13, 2020

(65) Prior Publication Data

US 2021/0267425 A1 Sep. 2, 2021

(30) Foreign Application Priority Data

Aug. 8, 2018 (EP) ..... 18187989

(51) Int. Cl.
*A47L 9/02* (2006.01)

(52) U.S. Cl.
CPC ..... *A47L 9/02* (2013.01)

(58) Field of Classification Search
CPC ..... A47L 9/248; A47L 9/242; A47L 11/4061; A47L 5/28; A47L 9/02; A47L 9/009; A47L 9/325; A47L 9/24
(Continued)

(56) References Cited

U.S. PATENT DOCUMENTS 1,139,736 A * 5/1915 Stabel ..... A47L 5/28 15/411
5,323,510 A * 6/1994 Redding ..... A47L 5/28 280/47.11

(Continued)

FOREIGN PATENT DOCUMENTS

CN 101262803 A 9/2008
CN 108135416 A 6/2018

(Continued)

OTHER PUBLICATIONS

Translation of JPH0668655U (Year: 2022).*

(Continued)

*Primary Examiner* — Edward F Landrum
*Assistant Examiner* — Sarah Akyaa Fordjour
(74) *Attorney, Agent, or Firm* — Schott, P.C.

(57) ABSTRACT

A vacuum cleaner nozzle (N) has a steering hinge arrangement (H1, H2) between a body (B) of the vacuum cleaner nozzle (N) and a connector (C) that is connectable to a unit having a handle, wherein the steering hinge arrangement (H1, H2) comprises first (H1) and second (H2) steering hinges, the first steering hinge (H1) being operational until a first steering angle, and the second steering hinge (H2) being operational from the first steering angle, a transmission ratio of the second steering hinge (H2) exceeding a transmission ratio of the first steering hinge (H1). As a result, a transmission ratio of the steering hinge arrangement (H1, H2) increases with an increasing steering angle also when the unit is substantially flat. The first steering angle may be determined by edges (E) on the first steering hinge (H1) interacting with a protrusion (P) on the second steering hinge (H2). A force exercised by a spring (S) between the second steering hinge (H2) and the body (B) may hamper the second steering hinge (H2) from being fully engaged before the first steering hinge (H1) has reached the first steering (Continued)

angle. The first steering hinge (H1) may be mounted at a larger angle with respect to a longitudinal axis of the connector (C) than the second steering hinge (H2). A vacuum cleaner advantageously comprises such a vacuum cleaner nozzle (N).

5 Claims, 2 Drawing Sheets

(58) Field of Classification Search
USPC ..... 15/411, 351; 403/52
See application file for complete search history.

(56) References Cited

U.S. PATENT DOCUMENTS

| | | | | |
|---|---|---|---|---|
| 6,553,613 | B2 * | 4/2003 | Onishi | A47L 9/242 15/351 |
| 7,979,959 | B2 * | 7/2011 | Courtney | A47L 9/02 15/415.1 |
| 9,027,200 | B2 * | 5/2015 | Chong | A47L 5/28 15/411 |
| 2003/0145422 | A1 * | 8/2003 | Kaffenberger | A47L 9/02 15/377 |
| 2009/0188067 | A1 * | 7/2009 | White | A47L 9/02 15/246.2 |
| 2011/0107553 | A1 | 5/2011 | Myers | |
| 2012/0079671 | A1 * | 4/2012 | Stickney | A47L 9/02 15/344 |
| 2012/0090105 | A1 * | 4/2012 | Henderson | A47L 9/02 15/300.1 |
| 2012/0233806 | A1 | 9/2012 | Streciwilk | |
| 2013/0315653 | A1 | 11/2013 | Jalbert | |

FOREIGN PATENT DOCUMENTS

| | | | | |
|---|---|---|---|---|
| CN | 108209714 | A | | 6/2018 |
| EP | 1214902 | | | 6/2002 |
| EP | 2521474 | | | 11/2012 |
| EP | 2815685 | | | 12/2014 |
| FR | 2847792 | | | 6/2004 |
| JP | H06-068655 | U | | 9/1994 |
| JP | H0668655 | U | * | 9/1994 |
| JP | 2006026170 | A | * | 2/2006 |
| JP | 2015-077228 | A | | 4/2015 |
| SE | 436394 | B | * | 12/1984 |
| WO | 2012042240 | | | 4/2012 |
| WO | 2012051550 | | | 4/2012 |
| WO | 2017017365 | A1 | | 2/2017 |
| WO | 2018060684 | | | 4/2018 |

OTHER PUBLICATIONS

Translation of SE436394B (Year: 2023).*
Translation of JP-2006026170-A (Year: 2024).*
International Search Report and Written Opinion Dated Nov. 4, 2019 for International Application No. PCT/EP2019/070293 Filed Jul. 20, 2019.

* cited by examiner

VACUUM CLEANER NOZZLE

CROSS REFERENCE TO RELATED APPLICATIONS

This application is the U.S. National Phase application under 35 U.S.C. § 371 of International Application No. PCT/EP2019/070293 filed Jul. 29, 2019, which claims the benefit of European Patent Application Number 18187989.1 filed Aug. 8, 2018. These applications are hereby incorporated by reference herein.

FIELD OF THE INVENTION

The invention relates to a vacuum cleaner nozzle, and to a vacuum cleaner comprising a vacuum cleaner nozzle.

BACKGROUND OF THE INVENTION

EP2521474=WO2012051550 discloses a surface cleaning device having a steering assembly. The surface cleaning device includes a foot, a handle assembly with a user manipulated handle, and a steering assembly coupling the handle assembly to the foot. The steering assembly includes a means for biasing the foot with respect to the handle assembly. Movement of the handle assembly stores energy within the biasing means so that the biasing means exerts a corresponding force on the foot.

FR2847792 discloses a suctioning device for vacuum cleaner. The device comprises an applicator and a tubular joint; the applicator is in one piece and the joint is associated with elastic return means exerted between the applicator and the duct element to define a predetermined stable position between them.

EP2815685 discloses a suction device for an electric vacuum cleaner. A connecting tube portion constituting a suction tool is constituted by at least a first connecting tube connected to a suction tool main body so as to be swingable and a second connecting tube rotatably coupled to the first connecting tube. A wheel portion is attached to a lower portion of the second connecting tube via a wheel attaching portion. A wheel supporting body is attached to the wheel attaching portion so as to be able to incline using a middle portion of the wheel supporting body of the wheel portion as a fulcrum.

WO2012042240 discloses a vacuum cleaner of the stick-vac type, comprising a handheld vacuum cleaner which is attached to an elongate, rigid wand and which is fluidly connected to a cleaner head provided at the end of the wand. The cleaner head is connected to the wand via a mechanical steering couple for directionally steering the cleaner head in plane parallel contact with the floor as the wand is rotated about its axis.

Nozzles for vacuum cleaners have a steering hinge, enabling the user to steer the nozzle by rotating the handle. With stick appliances the weight of the handheld is significant and needs to be moved around severely in order to rotate the tube to initiate the steering. A more reactive hinge is often implemented so that a relatively small user input results in a relatively large steering response. One of the downsides of a very reactive hinge is a nervous steering behavior, especially when the user does not want to steer but instead wants the nozzle to roll straight forward. Another downside of a very reactive hinge is compromised functionality while the entire appliance is flat on the ground e.g. when vacuuming under furniture. The hinge architecture becomes less stable when the tube angle to the ground decreases, and this gets worse when the hinge is more reactive, up to the point where the nozzle rotates freely during flat use.

SUMMARY OF THE INVENTION

It is, inter alia, an object of the invention to provide an improved vacuum cleaner nozzle. The invention is defined by the independent claims. Advantageous embodiments are defined in the dependent claims.

In accordance with an aspect of the invention, the invention provides a vacuum cleaner nozzle having a steering hinge arrangement between a body of the vacuum cleaner nozzle and a connector that is connectable to a unit having a handle, wherein a transmission ratio of the steering hinge arrangement increases with an increasing steering angle also when the unit is substantially flat, i.e. parallel to a surface to be cleaned. Herein, the transmission ratio represents how much the nozzle is rotated as a result of a user-induced rotation of the stick by rotating the handle. The transmission ratio may increase gradually or stepwise, and in the latter case the transmission ratio may have a first value up till a first steering angle, and a second value from the first steering angle. The stick may be long or short, and has a dust processing unit (e.g. a cyclone dust separator, a dust container, a fan, and a battery) close to the nozzle or close to the handle, and in the latter case the handle may be integrated with the dust processing unit. If the dust processing unit is close to the nozzle, the part of the stick that is connected to the nozzle may be just an input connector of the dust processing unit. The nozzle of the invention may also be used to advantage in combination with a canister vacuum cleaner, in which case a user induces a rotation of the stick by turning a handle attached to a hose.

In accordance with the invention, the steering hinge arrangement comprises first and second steering hinges, the first steering hinge being operational until a first steering angle, and the second steering hinge being operational from the first steering angle, a transmission ratio of the second steering hinge exceeding a transmission ratio of the first steering hinge.

In accordance with various advantageous embodiments, the first steering angle may be determined by edges on the first steering hinge interacting with a protrusion on the second steering hinge. A spring force exercised by a spring between the second steering hinge and the body may hamper the second steering hinge from being fully engaged before the first steering hinge has reached the first steering angle. The first steering hinge may be mounted at a larger angle with respect to a longitudinal axis of the connector than the second steering hinge. A vacuum cleaner advantageously comprising a dust processing unit and a handle, and such a vacuum cleaner nozzle.

These and other aspects of the invention will be apparent from and elucidated with reference to the embodiments described hereinafter.

DESCRIPTION OF EMBODIMENTS

Figure 1:
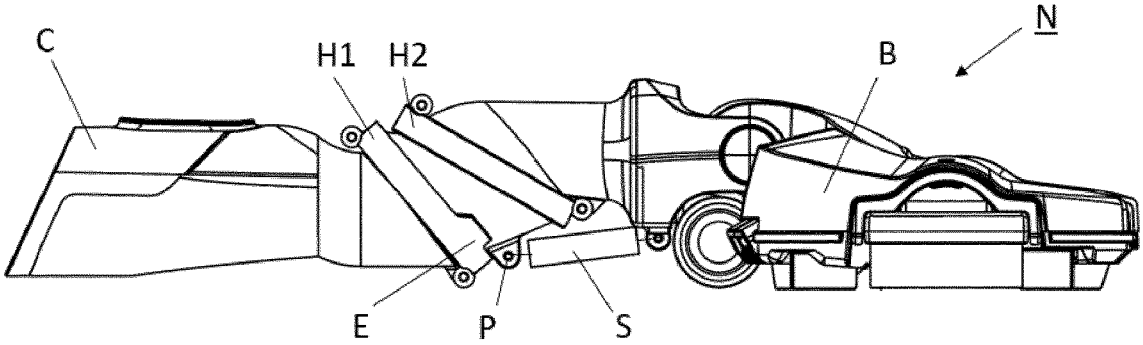
FIG. 1 shows a first embodiment of a nozzle in accordance with the present invention.

FIG. 1 shows a first embodiment of a nozzle N in accordance with the present invention. The nozzle N has a body B that interacts with the surface (floor) to be cleaned, and a connector C to which a stick of a stick vacuum cleaner can be connected. Between the connector C and the body B there is a steering hinge, which in this embodiment comprises two distinct steering hinges H1, H2, which are mounted at different angles with respect to the connector C. An elastic element (e.g. rubber or a spring) S connects a protrusion P on the second steering hinge H2 to the body B.

Figure 2A:
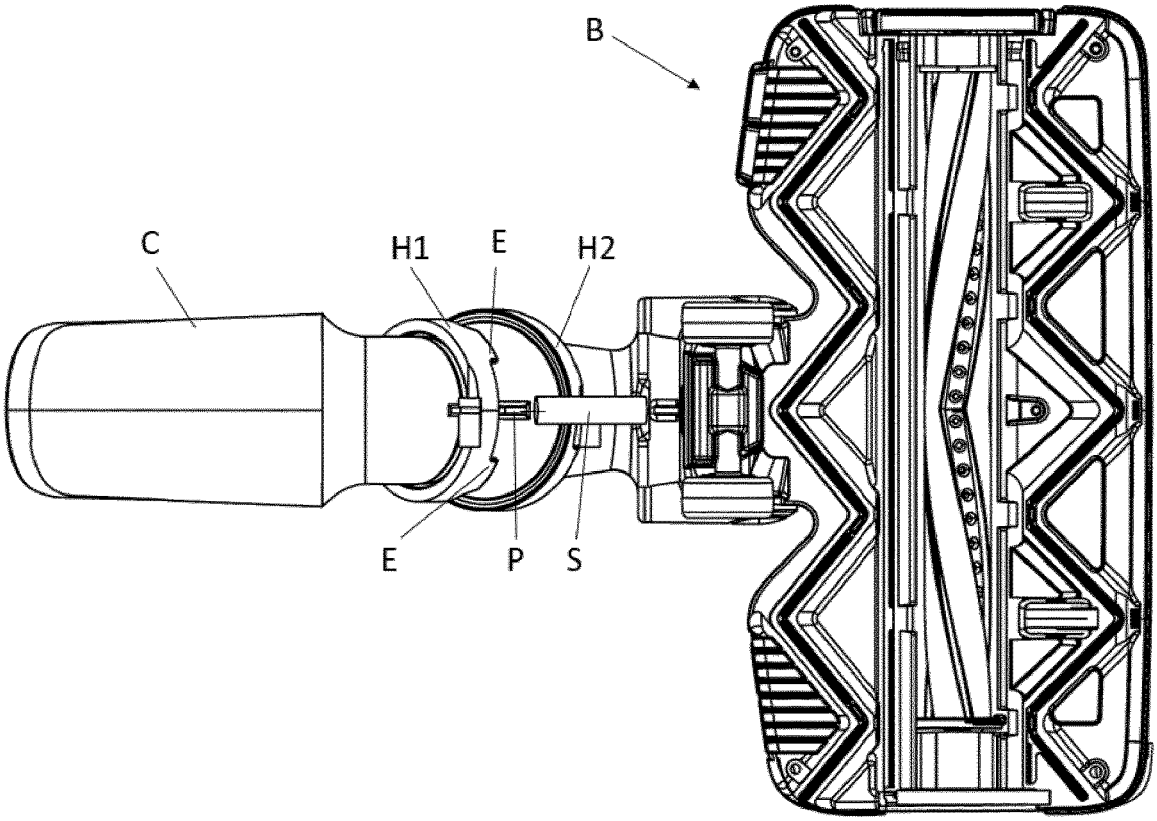
FIGS. 2A-2*c* show a bottom view of the embodiment of FIG. 1 in three different situations.
Figure 2B:
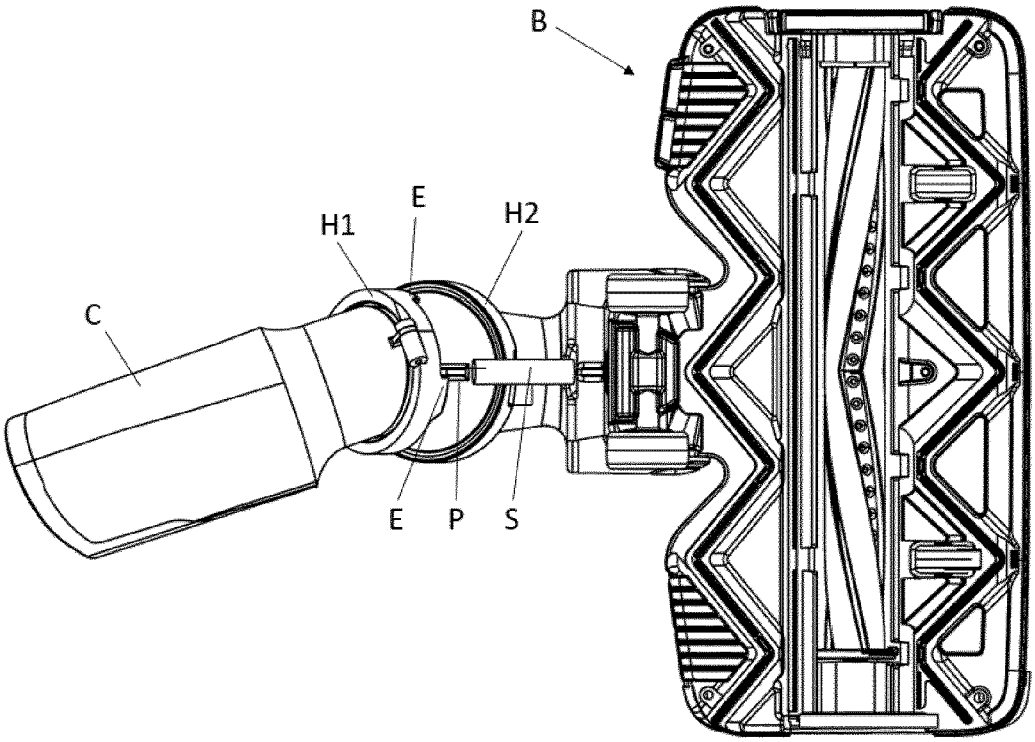
Figure 2C:
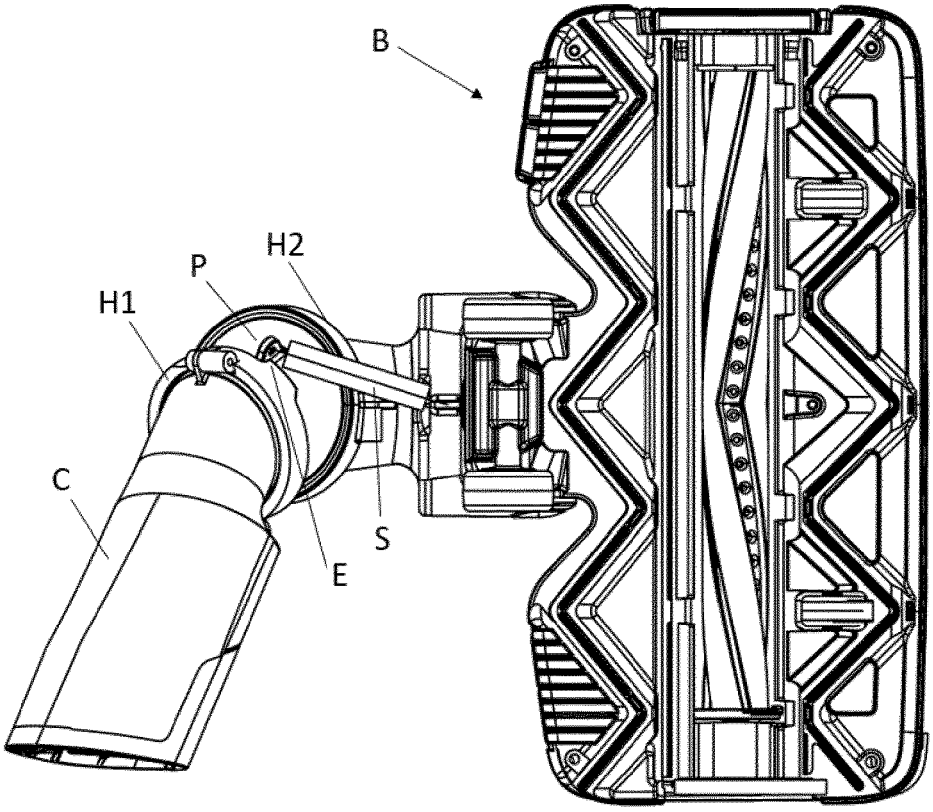

FIGS. 2A-2C show a bottom view of the embodiment of FIG. 1 in three different situations. In FIG. 2A, the nozzle is in a straight position. In FIG. 2B, as a result of a user rotating the stick, the connector C is rotated until a first steering angle which is the maximum angle of the first steering hinge H1. In FIG. 2C, as a result of the user rotating the stick beyond the first steering angle, the second hinge H2 has become active.

The first steering angle (i.e. the maximum steering angle of the first steering hinge H1) is the result of a complementary geometry, which in the shown embodiments is formed by first shaped features (e.g. formed by hooks or edges) E on the first steering hinge H1 bumping into second shaped features (e.g. formed by complementary hooks or the protrusion) P on the second steering hinge H2. These edges E thus prevent the first steering hinge H1 from rotating beyond the first steering angle. Instead of edges E, protrusions on the steering hinge H1 may interact with the protrusion P on the second steering hinge H2 so as the determine the first steering angle.

While the first steering hinge H1 is rotatable (i.e. up till the first steering angle), a spring force exercised by the spring S discourages the second steering hinge H2 from also rotating. However, after the first steering hinge H1 can no longer rotate with the rotating stick, the second steering hinge H2 takes over. Because the second steering hinge H2 is mounted at a smaller angle with respect to a longitudinal axis of the connector C than the first steering hinge H1, the steering behavior of the second steering hinge H2 is more aggressive than that of the first steering hinge H1. As a result, a transmission ratio of the overall steering hinge arrangement formed by the first and second steering hinges H1, H2 increases with an increasing steering angle.

It should be noted that the above-mentioned embodiments illustrate rather than limit the invention, and that those skilled in the art will be able to design many alternative embodiments without departing from the scope of the appended claims. The notion "a unit having a handle" may refer to a stick-type vacuum cleaner having a top-motor architecture e.g. as shown in WO2012042240, or to a stick-type vacuum cleaner having a down-motor architecture in which a stick with a handle is mounted in top of the vacuum cleaner body to maneuver the entire device, or to a canister-type vacuum cleaner in which the stick is removably mounted to a hose via a curved plastic part that constitutes the handle. While the drawings show the order connector C, first hinge H1, second hinge H2, nozzle body B, the order of the first hinge H1 and second hinge H2 may be reversed, and the claims should be construed accordingly. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention may be implemented by means of hardware comprising several distinct elements. In the device claim enumerating several means, several of these means may be embodied by one and the same item of hardware.

The invention claimed is:

1. A vacuum cleaner nozzle, comprising:

a steering hinge arrangement between a body of the vacuum cleaner nozzle and a connector that is connectable to a unit having a handle, wherein the steering hinge arrangement comprises first and second steering hinges, wherein the first steering hinge is rotatable until a first steering angle which is a maximum angle of a rotation of the first steering hinge, wherein the second steering hinge is rotatable from the first steering angle, wherein the rotation of the first steering hinge beyond the first steering angle activates the second steering hinge and prevents the rotation of the first steering hinge, wherein a transmission ratio of the second steering hinge exceeds a transmission ratio of the first steering hinge, wherein a transmission ratio of the steering hinge arrangement increases with an increase in second steering angle of the steering hinge arrangement, and wherein the second steering angle is associated with the steering hinge arrangement.

2. The vacuum cleaner nozzle as claimed in claim 1, wherein the first steering angle is determined by first shaped features on the first steering hinge interacting with second shaped features on the second steering hinge.

3. The vacuum cleaner nozzle as claimed in claim 1, wherein a force exercised by an elastic element between the second steering hinge and the body hampers the second steering hinge from being fully engaged before the first steering hinge has reached the first steering angle.

4. The vacuum cleaner nozzle as claimed in claim 1, wherein the first steering hinge is mounted at a larger angle with respect to a longitudinal axis of the connector than the second steering hinge.

5. A vacuum cleaner comprising a dust processing unit, a handle, and the vacuum cleaner nozzle as claimed in claim 1.

* * * * *